US006250073B1

(12) United States Patent
Zimmer et al.

(10) Patent No.: US 6,250,073 B1
(45) Date of Patent: Jun. 26, 2001

(54) EXHAUST SYSTEM OF AN INTERNAL-COMBUSTION ENGINE HAVING A STORAGE VOLUME

(75) Inventors: Rainer Zimmer, Neuried; Joachim Bettendorf, Munich, both of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/375,450

(22) Filed: Aug. 17, 1999

(30) Foreign Application Priority Data

Aug. 19, 1998 (DE) ..... 198 37 507
Aug. 19, 1998 (DE) ..... 198 37 509

(51) Int. Cl.[7] ..... F01N 5/00
(52) U.S. Cl. ..... 60/281; 60/276; 180/165
(58) Field of Search ..... 60/281, 276; 180/165

(56) References Cited

U.S. PATENT DOCUMENTS

| | | | | |
|---|---|---|---|---|
| 2,392,711 | * | 1/1946 | Willenborg | 60/281 |
| 3,645,098 | | 2/1972 | Templin et al. | 60/30 R |
| 3,674,441 | | 7/1972 | Cole . | |
| 3,977,375 | * | 8/1976 | Laprade et al. | 60/276 |
| 3,982,394 | * | 9/1976 | Hartel | 60/376 |
| 4,478,304 | * | 10/1984 | Delano | 180/165 |
| 5,524,433 | | 6/1996 | Adamczyk, Jr. et al. . | |

FOREIGN PATENT DOCUMENTS

| | | |
|---|---|---|
| 21 49 099 | 4/1972 | (DE) . |
| 22 22 498 | 12/1972 | (DE) . |
| 40 25 565 | 2/1992 | (DE) . |
| 43 42 296 | 3/1994 | (DE) . |
| 195 26 765 | 1/1997 | (DE) . |
| 1 349 051 | 3/1974 | (GB) . |

* cited by examiner

*Primary Examiner*—Thomas Denion
*Assistant Examiner*—Thai-Ba Trieu
(74) *Attorney, Agent, or Firm*—Crowell & Moring, L.L.P.

(57) ABSTRACT

An exhaust system of an internal-combustion engine (1) having an exhaust gas purification arrangement (3, 5) as well as a storage container (8) which can be evacuated and into which at least a portion of the internal-combustion engine exhaust gas flow can be introduced for a defined time period, particularly after a start of the internal-combustion engine. In addition to a stop valve (10), which maintains the vacuum in the storage container when the internal-combustion engine is stopped, a vacuum pump (18) is provided for evacuating the storage container. A stop flap (6) is provided in the exhaust system downstream of the exhaust gas purification arrangement. In a branch pipe (7) guiding the internal-combustion engine exhaust gas flow to the storage container (8), a control valve (9) may be provided for controlling the flow of exhaust gas to the storage container. In addition, the exhaust system may have a double-walled construction in areas, so that two essentially coaxially extending exhaust pipes exist, in which by way of the first, preferably interior exhaust pipe, the exhaust gas is guided away from the internal-combustion engine and, by way of the second, preferably exterior exhaust pipe, the exhaust gas is guided to the storage container.

9 Claims, 2 Drawing Sheets

EXHAUST SYSTEM OF AN INTERNAL-COMBUSTION ENGINE HAVING A STORAGE VOLUME

BACKGROUND AND SUMMARY OF THE INVENTION

This application claims the priority of German patents 198 37 507.7 and 198 37 509.3, both filed Aug. 19, 1998, the disclosures of which are expressly incorporated by reference herein.

The invention relates to an exhaust system of an internal-combustion engine having an exhaust gas purification arrangement as well as a storage container which can be evacuated and into which at least a portion of the internal-combustion engine exhaust gas flow can be introduced for a defined time period, particularly after a start of the internal-combustion engine. Concerning the known prior art, reference is made, in addition to German Patent Document DE 43 42 296 C1 and German Patent Document DE 40 25 565 A1, particularly to British Patent Document GB 1 349 051.

As known, the exhaust gases of a motor vehicle internal-combustion engine must be purified, that is, must be freed at least partially of harmful constituents, for which particularly exhaust gas catalysts are used. It is also known that these exhaust gas catalysts require a certain operating temperature so that they can fulfill their function of converting harmful exhaust gas constituents. Modern exhaust gas catalysts reach this so-called light-off temperature immediately after a (cold) start of the internal-combustion engine in conventional exhaust gas testing cycles only after approximately 25 seconds so that, during this time period—which in the following is also called a "critical" time period—, the internal-combustion engine emissions arrive in the environment in a virtually unpurified state.

As a remedial measure for these problems, it has been suggested to convey the internal-combustion engine emissions during this above-mentioned (critical) time period of, for example, 25 seconds into a storage container and to store it there until the exhaust gas catalyst has reached its light-off temperature or generally until the exhaust gas purification arrangement has reached is operationally ready state. Subsequently, the exhaust gas quantity situated in the storage container can then be fed to the operationally ready exhaust gas purification arrangement for the purification and/or to the internal-combustion engine (or its combustion space) for another combustion.

In practice, for storing the exhaust gas quantity emitted during the above-mentioned "critical" time period by the internal-combustion engine even at a low load (for example, during idling or the like), in addition to a relatively large storage container, a high-capacity feed pump is required which is abruptly completely active during a start of the internal-combustion engine and by way of which the exhaust gas quantity occurring in this time period is then delivered into the storage container in a pressurized manner.

The above mentioned British Patent Document GB 1,349, 051 contains the information that the once filled storage container can be optimally evacuated, whereby the storage capacity for the next cold start is to be increased simultaneously. However, the latter aspect does not seem very plausible.

It is an object of the invention to indicate improvements of this known prior art. The solution of this object is characterized in that, in addition to a stop valve which maintains the vacuum in the storage container when the internal-combustion engine is stopped, a vacuum pump is provided for generating the storage vacuum. By way of such a vacuum pump, a vacuum can generally be generated in the storage container and, by means of the stop valve, can be maintained such that, during the above-mentioned critical time period, by means of this vacuum, the internal-combustion engine emissions are delivered securely and efficiently into the storage container. In particular, also in the event of a possibly required repetitive start of the internal-combustion engine or after relatively long stoppage times of the internal-combustion engine, by means of such a vacuum pump, the vacuum desired in the storage container can be generated in a reliable manner, even before the internal-combustion engine is started.

Thus, in a branch pipe, which leads the internal-combustion engine emissions flow to the storage container, a control valve may be provided for the apportioned charging of the storage container, whereby, subsequent to a start of the internal-combustion engine, during the charging of the storage container which therefore takes place in a desired manner, the vacuum which first exists therein is not reduced abruptly but virtually in an apportioned manner. This permits a removal by suction of internal-combustion engine emissions from the internal-combustion engine exhaust pipe over a longer period of time. For the best-possible implementation of this method, in addition to a pressure sensor detecting the pressure value in the storage container, a control unit is preferably provided which appropriately controls the vacuum pump and/or the control valve by means of the pressure sensor signals.

In addition, a suitable adsorber material for an undesirable exhaust gas constituent may be provided in the storage container, so that the exhaust gases charged into the storage container are simultaneously at least partially purified before, after the expiration of the desired or required storage time period, they are fed back into the exhaust pipe of the internal-combustion engine.

In a further, particularly preferred embodiment, the exhaust system can be constructed to be double-walled in areas so that two, essentially mutually coaxial exhaust gas pipes exist, in which case, by way of the first, preferably interior exhaust gas pipe, the exhaust gas is guided away from the internal-combustion engine and is guided by way of the second, preferably outer exhaust gas pipe to the storage container.

By means of an exhaust system which, in areas, has a double-walled construction shown, for example, in German Patent Document DE-AS 22 22 498, the internal-combustion engine emissions are therefore first guided away from the internal-combustion engine in a first exhaust pipe and are then guided to the storage container, specifically back in the direction of the internal-combustion engine, in a second exhaust pipe which extends coaxially and concentrically to the first exhaust pipe. This double-walled section of the exhaust system is therefore similar to a counterflow heat exchanger. As the result of this measure, the exhaust system is heated more intensively in the double-walled section, which promotes a faster light-off of the exhaust gas catalyst or catalysts; that is, as a result of this measure, the exhaust gas purification system reaches its operating temperature sooner.

This increased heating is accompanied by an increased cooling of the exhaust gas flow guided to the storage container, whereby the volume of the exhaust gas quantity or the exhaust gas mass to be actually stored is reduced according to the physical state equation for gases. A larger exhaust gas quantity or exhaust gas mass can therefore be stored in the spatially limited storage container. In this case, it is particularly advantageous for the transition between the first and the second exhaust gas pipe to be provided with respect to the internal-combustion engine downstream of the exhaust gas purification arrangement, while an outlet from the second exhaust pipe into a branch pipe leading to the storage container is situated between the internal-combustion engine and the exhaust gas purification arrangement. The reason is that the exhaust system then has a double-wall construction also in the area of the exhaust gas purification arrangement, whereby the latter experiences a particularly intensive heating by internal-combustion engine emissions.

Another advantage of an exhaust system according to the invention is the fact that the exhaust system, which has a double-wall construction in areas, itself forms a portion of the storage container, specifically with a minimal additional space requirement, so that the actual storage container can be designed to be correspondingly smaller. In addition, it is particularly recommended to feed the exhaust gas quantity first stored during the so-called "critical" time period after the operational readiness has been reached to the exhaust gas purification arrangement of the internal combustion engine for (another) afterburning so that the storage container should preferably be arranged close to the internal-combustion engine. By means of an exhaust system according to the invention, a relatively simple exhaust gas guiding to the storage container arranged close to the internal-combustion engine is thus advantageously permitted.

Other objects, advantages and novel features of the present invention will become apparent from the following detailed description of the invention when considered in conjunction with the accompanying drawings.

DETAILED DESCRIPTION OF THE DRAWINGS

Figure 1:
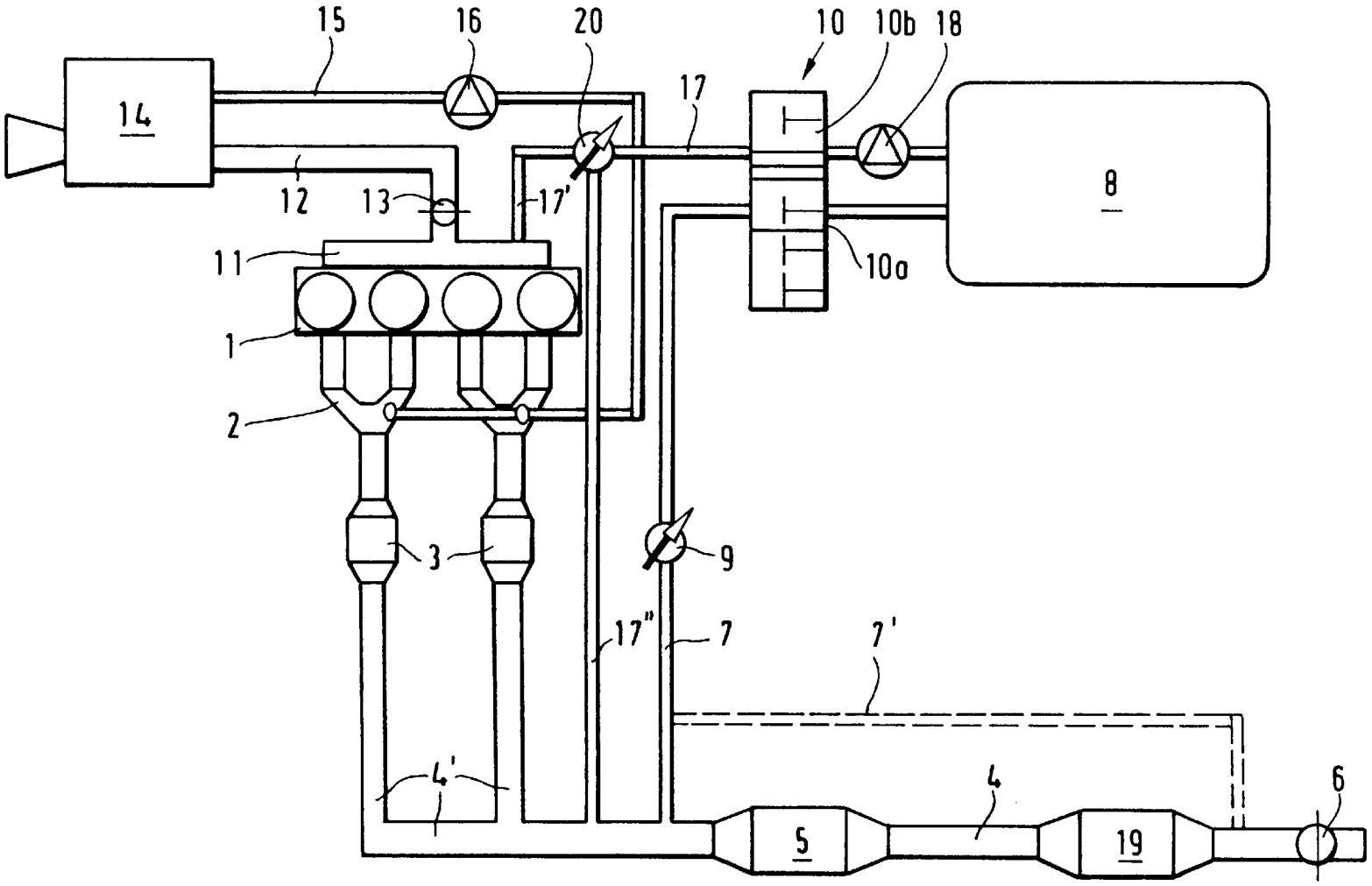
FIG. 1 is a schematic diagram showing an exhaust system of an internal-combustion engine having a storage volume according to a preferred embodiment of the present invention.

Reference number 1 indicates a (here, four-cylinder piston) internal-combustion engine, whose exhaust gases are guided by way of exhaust gas manifolds 2 first into electrically heatable precatalysts 3 (here, two precatalysts which are provided in parallel side-by-side). By way of exhaust gas pipes 4 (in FIG. 2, called the first exhaust gas pipe) or exhaust gas pipes 4' (FIG. 1), the internal-combustion engine exhaust gases then arrive in a main catalyst 5 and, from it, through an exhaust pipe 4, which has at least one sound absorber 19, finally in the environment. Downstream of the sound absorber 10, a stop flap 6 is provided in the exhaust pipe 4, by means of which stop flap 6 the exhaust pipe 4 can be essentially completely blocked off; that is, when the stop flap 6 is closed, the exhaust gas flow flowing through the sound absorber 19 cannot reach the environment.

In the following, reference will be made to the embodiment according to FIG. 1. When the stop flap 6 is closed, the exhaust gas flow guided in the exhaust pipe 4' is led into a storage container 8 by way of a branch pipe 7 branching off the exhaust pipe 4' upstream of the main catalyst 5. As an alternative, when the stop flap 6 is closed, the exhaust gas flow can also be taken out of the exhaust pipe 4 downstream of the main catalyst 5 or—as here by way of the branch pipe 7' illustrated by a broken line— downstream of the sound absorber 19 and can be supplied to the storage container 8. Naturally, for this purpose, a control valve 9 provided in the branch pipe 7 as well as another stop valve 10*a* constructed as a three-way valve 10 must be switched appropriately; that is, these two valves 9, 10*a*, whose function will be explained in detail in the following, must at least partially open up the flow of the exhaust gas through the branch pipe 7.

As explained initially, the just described introduction of the exhaust gas flow into the storage container 8, particularly after a (cold) start of the internal-combustion engine 1, when therefore the precatalysts 3 and the main catalyst 5 have not yet reached their light-off temperature and are thus not capable of converting harmful exhaust gas constituents (particularly hydrocarbons), must take place for a defined time period (of, for example, 25 seconds). If, after the expiration of this so-called "critical" time period, at least the precatalysts 3 have reached their light-off temperature and can then fulfill their function, the stop flap 6 is opened up so that then the exhaust gas flow is discharged into the environment in a purified manner, that is, freed at least of the important harmful substance constituents.

If the just described condition has been reached, the storage container 8 can be emptied in order to again, for a later (another) start or cold start of the internal-combustion engine 1 be capable of receiving the exhaust gas flow emitted during the above-mentioned time period of, for example, 25 seconds. This required emptying of the storage container 8 can take place either into the suction system 11 of the internal-combustion engine 1 or into the exhaust pipe 4'. For this purpose, an evacuating pipe 17 is provided which branches off the storage container 8 and which branches in a branch valve 20 into a first pipe branch 17' leading into the suction pipe 11 as well as into a second pipe branch 17" leading into the exhaust pipe 4'. As a function of the switching position of the branch valve 20, the exhaust gas quantity first stored in the storage container 8 is thus guided either for the "purification" (or aftertreatment) through the then operable main catalyst 5, or, as an alternative, is introduced into the suction system 11 of the internal-combustion engine 1. In the latter case, the exhaust gas quantity previously stored in the storage container 8 is thus, when this storage container 8 is emptied, for another afterburning, admixed in an appropriately apportioned manner to the carbureted fuel flow supplied to the internal-combustion engine combustion spaces for the combustion, specifically preferably at those operating points of the internal-combustion engine 1 in which this admixing does not hinder a perfect running of the internal-combustion engine 1.

In this context, the additional elements illustrated in FIG. 1 in the periphery of the internal-combustion engine will be briefly explained. By way of the above-mentioned suction system 11, as usual, the (here, four) combustion spaces of the internal-combustion engine 1 are supplied with carbureted fuel. Also as usual, a throttle valve 13 for controlling the power of the internal-combustion engine 1 is provided in an intake pipe 12 leading to the suction system 11. At the free end of the intake pipe 12, a conventional intake air filter 14 is situated. From this air filter 14, in addition to the intake pipe 12, a secondary air pipe 15 branches off which leads into the exhaust gas manifolds 2 and is known to a person skilled in the art, in which secondary air pipe 15, as usual, a secondary air pump 16 is provided, which, however, is not important for the present invention.

With respect to the above-mentioned emptying of the storage container 8 by way of the evacuating pipe 17, a vacuum pump 18 is visible in this evacuating pipe 17, in addition to a stop valve 10*b* which, in turn, is a component of the abovementioned three-way valve 10 or, together with the other above-mentioned stop valve 10*a*, forms this three-way valve 10. If the stop valve 10*a* is closed and the stop valve 10*b* is open, that is, the three-way valve 10 takes up the switching position illustrated in FIG. 1, during a simultaneous operation of this vacuum pump 18, the storage container 8 is sucked empty and is therefore evacuated because, by means of its suction side, this vacuum pump 18 is connected to the storage container 8. As mentioned above, the vacuum pump 18 then delivers the exhaust gas quantity situated in the storage container 8 by way of the evacuating pipe 17 either into the suction system 11 or into the exhaust pipe 4'.

However, this above-described delivery of the stored exhaust gas quantity from the storage container 8 into the suction system 11 is not the only function of the vacuum pump 18 because, when the stop valve 10*b* is open,—as the person skilled in the art knows—this would also take place virtually automatically (while the throttle valve 13 is at least partially closed) as the result of the vacuum existing at least intermittently in the suction system 11. It is another function of the vacuum pump 18 to generate an essentially absolute vacuum in the storage container 8, which vacuum is subsequently maintained by the corresponding switching of the three-way valve 10 or of the two stop valves 10*a*, 10*b*.

Thus, during an operation of the internal-combustion engine 1—after at least the precatalysts 3, generally an exhaust gas purification arrangement, have/has reached their/its temperature and after the exhaust gas quantity previously collected in the storage container 8 was removed from the storage container 8—an essentially absolute vacuum is generated in the storage container 8 which, because of the absolutely tightly closed stop valves 10*a*, 10*b*, is maintained also after a switching-off of the internal-combustion engine 1 until the next start.

If now, after an—even longer-lasting—stoppage, the internal-combustion engine 1 is started anew and simultaneously—as described above—the stop flap 6 in the exhaust pipe 4 is closed, and the control valve 9 and the stop valve 10*a* are opened up, on the basis of the vacuum existing in the storage container 8, the exhaust gas flow leaving the main catalyst 5 is sucked into the storage container 8. Naturally, the vacuum in the storage container 8 is therefore continuously reduced but, because of the at least initially still relatively high vacuum in the storage container, it is ensured that the exhaust gas quantity occurring in the abovementioned "critical" time period arrives securely in the storage container 8.

When the storage container 8 has an appropriate dimensioning or a suitable cubage, even the whole exhaust gas quantity occurring during the "critical" time period can be supplied by means of the above-mentioned initial vacuum into the storage container 8. However, deviating from the embodiment illustrated here, a feed pump may be additionally provided (which is shown in the initially mentioned prior art), which feed pump permits a storage of the occurring exhaust gas quantity in the storage container 8 under excess pressure, whereby this storage container 8 may be dimensioned to be smaller. Such a feed pump is illustrated at reference number 24 in FIG. 2 which will be explained below. In contrast to the prior art, because of the generating of the vacuum in the storage container 8, a lower-capacity feed pump (24) can now be used or—as in the above-mentioned German Patent Document DE 43 42 296 C1—, the internal-combustion engine 1 can be used for compressing the exhaust gas by an adaptation of its valve timing, after, as the result of the vacuum, which first (that is, at the start of the internal-combustion engine 1) exists in the storage container 8, an absolutely secure introduction of the exhaust gas flow into the storage container 8 is ensured.

This effect according to the invention will be explained again in the following using different terminology. It is known that the exhaust gas quantity, which occurs in the above-mentioned so-called "critical" time period of, for example, 25 seconds which, with respect to the exhaust gas emissions of the internal-combustion engine 1, follows its start, can be accommodated in a storage container (here, indicated at reference number 8) only when a pressure difference is generated with respect to the ambient pressure or atmospheric pressure. In the case of the present invention, this pressure difference is established by the vacuum which first exists in the storage container 8.

For the described charging of the storage container 8 by means of the vacuum originally existing therein, previously generated by the vacuum pump 18 and maintained by means of the stop valves 10*a*, 10*b*, the above-mentioned control valve 9, which is arranged in the branch pipe 7, can be particularly advantageous. The reason is that, in order to prevent that, with an opening of the stop valve 10*a*, the vacuum in the storage container 8 is abruptly reduced, this control valve 9 can form a throttling point in an appropriately controlled manner, which permits only a gradual reduction of the vacuum in the storage container 8 which lasts for a longer time period, that is, particularly for the above-mentioned time period of, for example, 25 seconds. The reason is that, if it has to be ensured that no exhaust gas at all reaches the environment in the above-mentioned critical time period, in the prior art, this is possible only in that a stop flap (here having the reference number 6) required in the exhaust pipe 4 is absolutely tightly closed. In contrast, in the case of the present invention, this absolute tightness requirement does not exist because, based on the vacuum—which may be controlled by the control valve 9—present at the exhaust pipe 4 and originating from the opened storage container, the exhaust gas carried in this exhaust pipe 4 is always sucked off in a secure and reliable manner into the storage container 8.

A control unit, which, in particular, is electronic and which, among other things, positions the stop flap 6 as well as the three-way valve 10, that is, the stop valves 10*a* and 10*b*, corresponding to the respective requirements, is not shown in the figures. Preferably by using the signals of a pressure sensor, which is provided particularly in the storage container 8 and senses the respective actual pressure value therein, this control unit can also take over the suitable triggering of the control valve 9 as well as of the vacuum pump 18. When the storage container 8 is charged during the "critical" time period, this control unit (optionally using additional signals or marginal conditions) can set an approximately constant vacuum of, for example, 0.75 bar by a suitable triggering of the control valve 9 in the mouth area of the branch pipe 7 and 7" into the exhaust pipe 4' and 4. During a later evacuation of the storage container 8, this control unit can ensure that this evacuation and the connected admixing of the exhaust gas quantity collected in the storage container 8 to the carbureted fuel flow supplied to the internal-combustion engine combustion spaces 1 takes place only in those operating points of the internal-combustion engine 1 in which this admixing does not hinder a perfect running of the internal-combustion engine.

Furthermore, during the subsequent buildup of the vacuum in the storage container 8, the above-mentioned control unit can monitor the operation of the vacuum pump 18 such that the desired vacuum is generated in the storage container 8 in the desired magnitude. It is pointed out in this context that it is basically desirable, after the completed evacuation of the storage container 8, during the operation of the internal-combustion engine 1, to build up the desired vacuum in this storage container 8 once and then maintain it by keeping the stop valves 10*a*, 10*b* closed for a long period of time—particularly also after a switching-off of the internal-combustion engine 1, to its next start—. However, it is also possible to continuously monitor the vacuum in the storage container 8 and, also when the internal-combustion engine 1 is stopped, provide by the intermittent operation of the vacuum pump 18 that the desired (or, with respect to the hereby achievable reduction of the exhaust gas emissions, required) vacuum for a new start of the internal-combustion engine 1 always exists. As an alternative, it is also possible to permit a start of the internal-combustion engine 1 only if the desired vacuum is present in the storage container 8. Thus, if required, before a start of the internal-combustion engine 1—similar to the preheating in the case of self-ignition internal-combustion engines—, the vacuum pump 18 must first be operated until the vacuum has been generated in the storage container 8.

If the vacuum pump 18 is to be operated also when the internal-combustion engine 1 is stopped, its delivery side should be connected with the environment, for example, by way of the evacuation pipe 17" and the exhaust pipe 4. In this context, it should also be pointed out that, because of the fact that the delivery side of the vacuum pump 18 can be connected with the suction system 11 of the internal-combustion engine 1, a reduced pump capacity is required if, in addition, the vacuum existing in the suction system 11, in the case of a plurality of internal-combustion engine operating points (and particularly intensively in the idling operation), as known to the person skilled in the art—is also utilized. In this respect, the above-mentioned control unit can appropriately drive the vacuum pump 18.

With reference to the embodiment according to FIG. 1, it should also be pointed out that, by means of a branch pipe 7' branching off the exhaust pipe 4 downstream of the sound absorber 5, following a start of the internal-combustion engine 1, not only the main catalyst 5 (as well as naturally also the precatalysts 3) is heated in a desirable manner by the exhaust gas flow guided through, but the exhaust gas flow is simultaneously cooled, whereby the volume of the exhaust gas quantity to be stored is reduced (according to the physical state equation for gases). Therefore, a larger exhaust gas quantity, or more precisely, exhaust gas mass, can be stored in the storage container 8.

The detailed construction of the storage container 8 will not be discussed in detail. This may essentially be a suitable vacuum accumulator which is stable in the case of a full evacuation. Naturally, an ideally absolute tightness not only of the vacuum accumulator or of the storage container 8 but also of the stop valves 10*a*, 10*b* (or of the three-way valve 10) as well as of the evacuation pipe 17 and of the branch pipe 7 is required.

Finally, an adsorber material may also be provided in the storage container 8 and itself stores at least one undesirable exhaust gas constituent for a certain time period, or has a harmful-substance-adsorbing effect—as known to a person skilled in the art, for example, as activated carbon.

Figure 2:
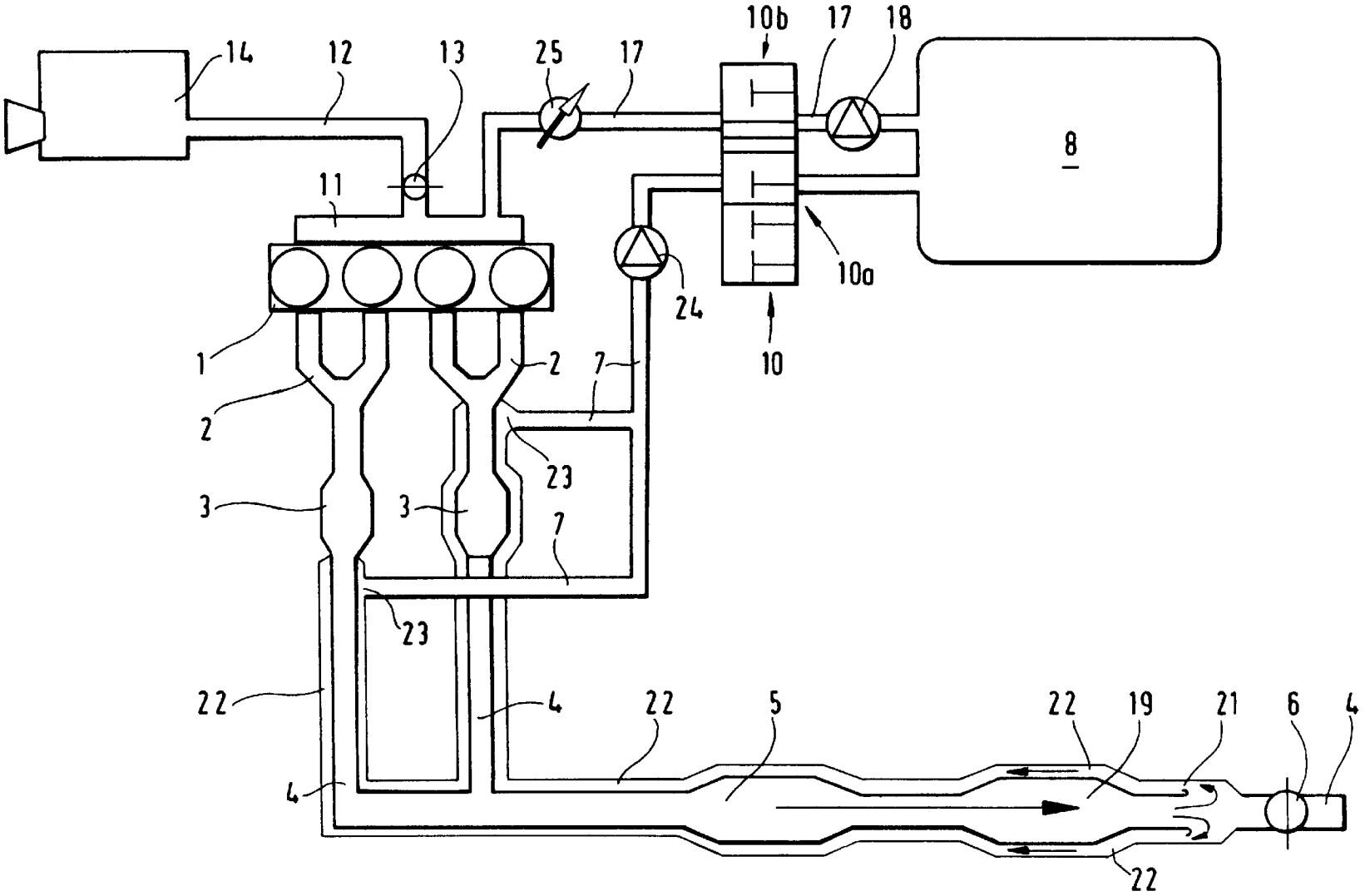
FIG. 2 is a schematic showing an exhaust system of an internal-combustion engine having a storage volume according to another preferred embodiment of the present invention.

In the following, FIG. 2 or the important differences between this second embodiment and that according to FIG. 1 will be described.

While, in the normal continuous internal-combustion engine operation, the internal-combustion engine exhaust gases arrive through the here so-called first exhaust pipe 4, as indicated by the flow arrow, by way of the main catalyst 5 as well as by way of the sound absorber, finally in the environment, here also, during the above-mentioned "critical" time period which follows a start of the internal-combustion engine 1 and during which neither the precatalysts 3 nor the main catalyst 5 have reached their or its light-off or operating temperature, the stop flap 6 provided in the exhaust pipe 4 downstream of the sound absorber 19 is closed so that the first exhaust pipe 4 at this point is essentially completely blocked. When the stop flap 6 is closed, the exhaust gas flow flowing through the sound absorber 19 cannot reach the environment but is guided into a storage container 8. In the embodiment according to FIG. 2, this takes place in the following manner.

Between the sound absorber 19 and the exhaust gas flap 6, that is, upstream thereof, a transition into a second exhaust pipe 22 is provided in the first exhaust pipe 4, in which second exhaust pipe 22 the exhaust gas flow arrives—as indicated by the flow arrows—when the stop flap 6 is closed. This second exhaust pipe 22 is arranged coaxially or concentrically to the first exhaust pipe 4 or surrounds the first exhaust pipe 4, an annulus, which is not described in greater detail, being situated between the exterior wall of the first exhaust pipe 4 and the interior wall of the second exhaust pipe 22, through which annulus the internal-combustion engine exhaust gases are then guided in the second exhaust pipe 22. This second exhaust pipe 22 extends from the transition 21 in the direction of the internal-combustion engine 1 (back) to a so-called outlet 23, which is provided on the precatalyst 3, which is on the left side here, with respect to the flow direction in the second exhaust pipe 22 upstream thereof, and for the precatalyst, which is on the right side here, between this precatalyst 3 and the internal-combustion engine 1.

In the area between the outlet 23 and the transition 21, the illustrated internal-combustion engine exhaust system therefore has a double-walled construction, in which case not only the exhaust pipe 4 but also the exhaust gas purification arrangements in the form of the main catalyst 5 as well as the precatalyst, which is on the right here, are surrounded by the exhaust pipe 22.

The outlet 23 or the end of the second exhaust pipe 22 surrounding the first exhaust pipe 4 preferably coaxially is adjoined by the branch pipe 7 which was described in connection with the first embodiment and which finally leads into the also already explained storage container 8. When the stop flap 6 is closed, the internal-combustion engine exhaust gases are therefore introduced by way of the second exhaust pipe 22 as well as the adjoining branch pipe 7 into the storage container 8. Naturally, also in this case, the stop valve 10*a* constructed as a three-way valve 10 and provided in the branch pipe 7 must be switched appropriately; that is, this stop valve 10*a* must open up the flow of the exhaust gas through the branch pipe 7. In this context, reference is also made to the feed pump which is provided in the branch pipe 7 and by means of which the internal-combustion engine exhaust gas introduced into the storage container 8 can be compressed in the storage container 8, so that this storage container 8 has a cubage which is still acceptable for the storage of the exhaust gas quantity occurring in the above-mentioned "critical" time period.

As explained initially, the above-described introduction of the exhaust gas flow into the storage container 8, particularly after a (cold) start of the internal-combustion engine 1—when therefore the precatalysts 3 and the main catalyst 5 have not yet reached their light-off temperature and therefore are not capable of converting harmful exhaust gas constituents (particularly hydrocarbons)—, is to take place for a defined time period (of, for example, 25 seconds). When, after the expiration of this so-called "critical" time period, at least the precatalysts 3 have reached their light-off temperature and can then fulfill their function, the stop flap 6 is opened up, so that then the exhaust gas flow is discharged in a purified state, that is, freed of at least the important harmful-substance constituents, into the environment.

When the above-described state has been reached, the storage container 8 can be evacuated in order to be capable again, for a later (new) start or cold start of the internal-combustion engine 1, to accommodate the exhaust gas flow emitted during the above-mentioned time period of, for example, 25 seconds. In this second embodiment, this required evacuation of the storage container 8 takes place only in the suction system 11 of the internal-combustion engine 1, specifically by way of the evacuation pipe 17, a targeted quantity control of the exhaust gas quantity taken from the storage container 8 and fed to the suction system 11 and thus returned taking place by means of a control valve 25 provided in the evacuation pipe 17.

Also in this case, the vacuum pump 18 explained above in conjunction with the embodiment according to FIG. 1 is situated in the evacuation pipe 17. Therefore, during the operation of the internal-combustion engine 1—after at least the precatalysts 3, generally an exhaust gas purification arrangement, have/has reached their/its operating temperature and after the exhaust gas quantity previously collected in the storage container 8 has been removed from the storage container—by means of this vacuum pump 18, an essentially absolute vacuum is generated in the storage container 8. Because of the absolutely tightly closed stop valves 10*a*, 10*b*, this vacuum is maintained also after a switching-off of the internal-combustion engine 1 until its next start or, as required, is generated again before a start of the internal-combustion engine 1 by starting the operation of the vacuum pump 18.

Concerning the introduction of the internal-combustion engine exhaust gas into the storage container 8 during the above-mentioned so-called "critical" time period which follows a start of the internal-combustion engine, the important advantages of the exhaust system which, according to the invention, has a double-walled construction in areas, will finally be briefly repeated.

In that the internal-combustion engine exhaust gas, before an introduction into the storage container 8, first flows by way of the first exhaust pipe 4 through the precatalysts 3 and through the main catalyst 5 and subsequently—guided in the second exhaust pipe 22—flows on the outside not only around these exhaust gas purification arrangements (specifically the main catalyst 5 as well as optionally the precatalyst 3) but also around the exhaust pipe 4, these above-mentioned elements of the internal-combustion engine exhaust system are heated in the desired accelerated manner so that the exhaust gas purification device(s) can reach its/their light-off or operating temperature faster, whereby the so-called "critical" time period is shortened and thus the exhaust gas quantity to be accommodated in the storage container 8 is reduced.

Advantageously, in this manner, the exhaust gas flow is cooled simultaneously, whereby the volume of the exhaust gas quantity to be stored is reduced (according to the physical state equation for gases) so that a larger exhaust gas quantity, that is, exhaust gas mass, can therefore be stored in a storage container 8 whose cubage is defined.

In this case, it should be explicitly pointed out that these above-mentioned effects occur because of the fact that the exhaust system has a double-walled construction in areas so that the internal-combustion engine exhaust gas in this area is guided away from the internal-combustion engine in a first exhaust pipe 4, which contains the exhaust gas purification arrangement(s) and, in a second exhaust pipe 22, which extends coaxially to the first, in the manner of a counterflow heat exchanger, is returned again in the direction of the internal-combustion engine 1, but, in the process, is finally introduced into the storage container 8. For achieving these advantageous effects, it is not absolutely necessary that the first exhaust pipe 4 is the interior and the second exhaust pipe 22 is the exterior exhaust pipe of the exhaust system having in areas a double-wall construction and an annulus. On the contrary, the first exhaust pipe 4 can also be provided on the exterior and the second exhaust pipe can be provided in the interior, in which case the latter would then penetrate the exhaust gas purification arrangements, that is, the main catalyst 5 and the precatalyst or precatalysts 3.

Naturally, a large number of further modifications of the described embodiment are conceivable without leaving the content of the claims. Thus, the transition 21 or the start of the second exhaust pipe 22 can also be situated between the sound absorber 19 and the main catalyst 5 or also upstream of the latter. It is always particularly advantageous for a specific area of the exhaust system to have the described double-walled construction, in which case it should also be pointed out that also this double-walled area of the exhaust system virtually forms a partial volume of the storage container 8, so that the latter can advantageously have a correspondingly reduced cubage.

Although the detailed construction of the storage container 8 is not discussed in detail—it may essentially be a suitable vacuum accumulator which, in the embodiment illustrated here, is stable in connection with the vacuum pump 18 also when evacuated completely—, a particularly advantageous embodiment of the storage container 8, which is not shown, will be mentioned here briefly, according to which the storage container 8 may be constructed virtually in two parts. In addition to a first partial volume, which can be evacuated in the described manner, a second partial volume may be provided in which the internal-combustion exhaust gas can be stored in a compressed manner by means of the feed pump 24. In addition, naturally a large number of further details, particularly of a constructive type, can be designed to deviated from the described embodiments without leaving the content of the patent claims.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust system of an internal-combustion engine, comprising:

an exhaust gas purification arrangement;

a storage container which is evacuable and which is communicates with at least a portion of the internal-combustion engine exhaust gas flow for a defined time period via a stop valve which is operable to maintain a vacuum in the storage container when the internal-combustion engine is stopped;

and a vacuum pump communicating with the storage container which is operable to evacuate the exhaust gas.

2. The internal-combustion engine exhaust system according to claim 1, wherein a delivery side of the vacuum pump is communicated with at least one of a suction system of the internal-combustion engine and an exhaust pipe portion located upstream of the exhaust gas purification arrangement.

3. The internal-combustion engine exhaust system according to claim 1, further comprising:

a stop flap provided in the exhaust system downstream of the exhaust gas purification arrangement;

and a control valve arranged in a branch pipe guiding the internal-combustion engine exhaust gas flow to the storage container, said control valve controlling the flow of exhaust gas to the storage container.

4. The internal-combustion engine exhaust system according to claim 1, further comprising:

a pressure sensor which senses a pressure value in the storage container; and a control unit which controls at least one of the vacuum pump and the control valve based on signals from the pressure sensor.

5. The internal-combustion engine exhaust system according to claim 1, further comprising at least one adsorber material arranged in the storage container, said at least one adsorber material adsorbing an undesirable exhaust gas constituent.

6. Exhaust system according to claim 1, wherein at least a portion of the exhaust system has a double-walled construction including two exhaust pipes extending essentially coaxially and concentrically, the exhaust gas being guided away from the internal-combustion engine via an interior one of said exhaust pipes, the exhaust gas being guided toward the storage container via an exterior one of said exhaust pipes.

7. Internal-combustion engine exhaust system according to claim 6, further comprising:

a stop flap provided in said interior exhaust pipe downstream of the exhaust gas purification arrangement; and a transition provided in said exterior exhaust pipe.

8. Internal-combustion engine exhaust system according to claim 6, wherein an outlet is provided in an exhaust pipe section between the internal-combustion engine and a portion of the exhaust gas purification arrangement constructed as a precatalyst, said outlet communicating said exterior exhaust pipe with the storage container via a branch pipe.

9. Internal-combustion engine exhaust system according to claim 1, further comprising:

a branch pipe guiding the internal-combustion exhaust gas to the storage container; and a feed pump arranged in said branch pipe.

* * * * *